US009506702B2

(12) United States Patent
Visinski et al.

(10) Patent No.: US 9,506,702 B2
(45) Date of Patent: Nov. 29, 2016

(54) EXTERNALLY LOADING SEMI-AUTOMATIC FIREARM WITH INTEGRAL OR NON-REMOVABLE FEEDING DEVICE

(71) Applicant: JV PRECISION MACHINE COMPANY, Seymour, CT (US)

(72) Inventors: Josef Visinski, Shelton, CT (US); Andrew Visinski, Shelton, CT (US); William McCarson, Orange, CT (US); Jesse Gomez, Trappe, MD (US); Robert Stanley Schilling, Easton, MD (US)

(73) Assignee: JV PRECISION MACHINE COMPANY

( * ) Notice: Subject to any disclaimer, the term of this patent is extended or adjusted under 35 U.S.C. 154(b) by 0 days.

(21) Appl. No.: 14/593,513

(22) Filed: Jan. 9, 2015

(65) Prior Publication Data

US 2015/0198395 A1 Jul. 16, 2015

Related U.S. Application Data

(60) Provisional application No. 61/925,783, filed on Jan. 10, 2014.

(51) Int. Cl.
*F41A 3/66* (2006.01)
*F41A 9/02* (2006.01)
(Continued)

(52) U.S. Cl.
CPC .. *F41A 3/66* (2013.01); *F41A 9/52* (2013.01); *F41A 9/67* (2013.01)

(58) Field of Classification Search
CPC ..... F41A 9/00; F41A 9/01; F41A 9/20; F41A 9/23; F41A 9/38; F41A 9/48; F41A 9/52; F41A 9/61; F41A 9/64; F41A 9/65; F41A 9/66; F41A 9/67; F41A 9/70; F41A 9/11; F41A 9/12; F41A 9/13; F41A 9/15; F41A 9/09; F41A 9/16; F41A 9/17; F41A 9/21; F41A 9/22; F41A 9/54; F41A 9/55; F41A 9/58; F41A 3/66; F41A 9/24; F41A 9/26; F41A 9/82; F41A 9/83; F41A 9/84; F41B 11/50; F41B 11/51
USPC ..... 42/11, 17, 18, 21, 22, 29, 33, 35, 37, 42/39, 6, 7, 49.01, 49.02, 50, 87, 88; 89/33.01, 33.03, 33.1
See application file for complete search history.

(56) References Cited

U.S. PATENT DOCUMENTS 894,530 A * 7/1908 Punches ..... 42/22
1,348,702 A 8/1920 Gabbett-Fairfax
(Continued)

FOREIGN PATENT DOCUMENTS

WO WO-95/08090 3/1995
WO WO-2008/108804 9/2008

OTHER PUBLICATIONS

In the U.S. Patent and Trademark Office, Notice of Allowance in re: U.S. Appl. No. 13/430,281, dated Apr. 17, 2013, 6 pages.
(Continued)

*Primary Examiner* — Bret Hayes
*Assistant Examiner* — Derrick Morgan
(74) *Attorney, Agent, or Firm* — Porzio, Bromberg & Newman P.C.

(57) ABSTRACT

Weapon and rifle systems and methods with integral or non-removable ammunition well or reservoir are described. A lower receiver for an M16 type weapon or rifle system is described with an aperture for loading one or more cartridges into an ammunition well or reservoir formed as part of the lower receiver, a pull channel, a follower pull coupled to the pull channel, a follower adapted for retraction by the follower pull, a bottom cover to the ammunition well or reservoir, wherein the pull channel and follower pull are capable of retracting the follower past the aperture for loading one or more cartridges into the ammunition well or reservoir. Also described is a weapon or rifle system using the lower receiver described herein and a method for loading a weapon or rifle system using the lower receiver as described herein.

19 Claims, 2 Drawing Sheets

(51) Int. Cl.
*F41A 9/52* (2006.01)
*F41A 9/67* (2006.01)

(56) References Cited

U.S. PATENT DOCUMENTS 1,348,733 A 8/1920 Pedersen
1,568,005 A 12/1925 Sutter
1,737,974 A 12/1929 Pedersen
1,797,951 A * 3/1931 Gaidos ..... 42/50
1,994,489 A 3/1935 Simpson
2,090,656 A 8/1937 Williams
2,100,410 A 11/1937 Pugsley
2,137,491 A * 11/1938 Huff ..... 42/90
2,275,213 A * 3/1942 Wise ..... 42/50
2,336,146 A 12/1943 Williams
2,377,692 A 6/1945 Johnson, Jr.
2,424,194 A 7/1947 Sampson et al.
2,426,563 A 8/1947 Patchett
2,482,758 A 9/1949 Gaidos
2,532,794 A 12/1950 Teece
2,611,297 A 9/1952 Simpson
2,655,754 A * 10/1953 Brush ..... 42/50
2,858,741 A 11/1958 Simpson
2,872,849 A 2/1959 Simpson
2,910,795 A * 11/1959 Agren ..... F41A 9/67 206/3
2,952,934 A 9/1960 Yovanovitch
2,971,441 A 2/1961 Reed
3,027,672 A 4/1962 Sullivan
3,366,011 A 1/1968 Sturtevant
3,446,114 A 5/1969 Ketterer
3,453,762 A * 7/1969 Fremont ..... 42/50
3,618,455 A 11/1971 Plumer et al.
3,618,457 A 11/1971 Miller
3,630,119 A 12/1971 Perrine
3,636,647 A 1/1972 Goldin
3,675,534 A 7/1972 Beretta
3,771,415 A 11/1973 Into et al.
3,776,095 A 12/1973 Atchisson
3,803,739 A * 4/1974 Haines et al. ..... 42/6
3,857,323 A 12/1974 Ruger et al.
3,869,961 A 3/1975 Kawamura
4,016,667 A * 4/1977 Forbes ..... 42/6
4,028,993 A 6/1977 Reynolds
4,057,003 A 11/1977 Atchisson
4,128,042 A 12/1978 Atchisson
4,226,041 A * 10/1980 Goodworth ..... 42/50
4,244,273 A 1/1981 Langendorfer, Jr. et al.
4,279,191 A 7/1981 Johansson
4,416,186 A 11/1983 Sullivan
4,433,610 A 2/1984 Tatro
4,475,437 A 10/1984 Sullivan
4,502,367 A 3/1985 Sullivan
4,503,632 A 3/1985 Cuevas
4,505,182 A 3/1985 Sullivan
4,553,469 A 11/1985 Atchisson
4,563,937 A 1/1986 White
D285,236 S 8/1986 Brunton
4,654,993 A 4/1987 Atchisson
4,658,702 A 4/1987 Tatro
4,663,875 A 5/1987 Tatro
4,677,897 A 7/1987 Barrett
4,688,344 A * 8/1987 Kim ..... 42/50
4,693,170 A 9/1987 Atchisson
4,702,146 A 10/1987 Ikeda et al.
4,735,007 A 4/1988 Gal
4,765,224 A 8/1988 Morris
4,872,279 A * 10/1989 Boat ..... 42/90
4,893,426 A 1/1990 Bixler
4,893,547 A 1/1990 Atchisson
5,038,666 A 8/1991 Major
5,117,735 A 6/1992 Flashkes
5,173,564 A 12/1992 Hammond, Jr.
5,183,959 A 2/1993 McCoan et al.
5,198,600 A 3/1993 E'Nama
5,272,956 A 12/1993 Hudson
5,343,650 A 9/1994 Swan
5,351,598 A 10/1994 Schuetz
5,412,895 A 5/1995 Krieger
5,448,940 A 9/1995 Schuetz et al.
5,452,534 A * 9/1995 Lambie ..... 42/18
5,551,179 A 9/1996 Young
5,565,642 A * 10/1996 Heitz ..... 89/7
5,590,484 A 1/1997 Mooney et al.
5,634,288 A 6/1997 Martel
5,678,343 A 10/1997 Menges et al.
5,726,377 A 3/1998 Harris et al.
5,770,814 A 6/1998 Ealovega
5,806,224 A * 9/1998 Hager ..... 42/18
5,826,363 A 10/1998 Olson
5,827,992 A 10/1998 Harris et al.
5,900,577 A 5/1999 Robinson et al.
5,907,919 A 6/1999 Keeney
6,019,024 A 2/2000 Robinson et al.
6,070,352 A 6/2000 Daigle
6,071,523 A 6/2000 Mehta et al.
6,134,823 A 10/2000 Griffin
6,182,389 B1 2/2001 Lewis
6,227,098 B1 5/2001 Mason
6,311,603 B1 11/2001 Dunlap
6,382,073 B1 5/2002 Beretta
6,418,655 B1 7/2002 Kay
6,508,027 B1 1/2003 Kim
6,536,153 B2 3/2003 Lindsey
6,564,492 B2 5/2003 Weldle et al.
6,606,812 B1 8/2003 Gwinn, Jr.
6,634,274 B1 10/2003 Herring
6,651,371 B2 11/2003 Fitzpatrick et al.
6,655,069 B2 12/2003 Kim
6,655,372 B1 12/2003 Field et al.
6,668,815 B1 12/2003 Fernandez
6,671,990 B1 1/2004 Booth
6,681,677 B2 1/2004 Herring
6,718,680 B2 4/2004 Roca et al.
6,722,255 B2 4/2004 Herring
6,792,711 B2 9/2004 Battaglia
6,820,533 B2 11/2004 Schuerman
6,829,974 B1 12/2004 Gwinn, Jr.
6,848,351 B1 2/2005 Davies
6,851,346 B1 2/2005 Herring
6,901,691 B1 6/2005 Little
6,945,154 B1 9/2005 Luth
6,959,509 B2 11/2005 Vais
6,971,202 B2 12/2005 Bender
7,036,259 B2 5/2006 Beretta
7,082,709 B2 8/2006 Lindsey
7,131,228 B2 11/2006 Hochstrate et al.
7,137,217 B2 11/2006 Olson et al.
7,162,822 B1 1/2007 Heayn et al.
7,213,498 B1 5/2007 Davies
7,216,451 B1 5/2007 Troy
7,219,462 B2 5/2007 Finn
7,231,861 B1 6/2007 Gauny et al.
7,243,453 B2 7/2007 McGarry
7,299,737 B2 11/2007 Hajjar et al.
7,313,883 B2 1/2008 Leitner-Wise
7,316,091 B1 1/2008 Desomma
7,428,795 B2 9/2008 Herring
7,444,775 B1 11/2008 Schuetz
7,461,581 B2 12/2008 Leitner-Wise
7,478,495 B1 1/2009 Alzamora et al.
7,497,044 B2 * 3/2009 Cammenga et al. ..... 42/50
D590,473 S 4/2009 Fitzpatrick et al.
7,533,598 B1 5/2009 Murphy
D603,012 S 10/2009 Fitzpatrick et al.
7,596,900 B2 10/2009 Robinson et al.
7,634,959 B2 12/2009 Frickey
7,661,219 B1 2/2010 Knight, Jr. et al.
7,698,844 B2 * 4/2010 Gruber et al. ..... 42/50
7,707,762 B1 5/2010 Swan
7,715,865 B2 5/2010 Camp, Jr.
7,716,865 B2 5/2010 Daniel et al.
7,735,410 B2 6/2010 Clark
7,743,542 B1 6/2010 Novak

(56) References Cited

U.S. PATENT DOCUMENTS 7,762,018 B1 7/2010 Fitzpatrick et al.
7,775,150 B2 8/2010 Hochstrate et al.
7,784,211 B1 8/2010 Desomma
7,793,453 B1 9/2010 Sewell, Jr. et al.
7,806,039 B1 10/2010 Gomez
7,832,326 B1 11/2010 Barrett
7,886,470 B1 2/2011 Doiron
D636,043 S 4/2011 Olsen et al.
7,930,968 B2 4/2011 Giefing
7,963,203 B1 6/2011 Davies
7,966,760 B2 6/2011 Fitzpatrick et al.
D641,451 S 7/2011 Gomez et al.
7,975,595 B2 7/2011 Robinson et al.
8,037,806 B2 10/2011 Davies
8,051,595 B2 11/2011 Hochstrate et al.
8,061,072 B1 11/2011 Crose
8,141,285 B2 3/2012 Brown
8,141,289 B2 3/2012 Gomez et al.
8,181,563 B1 5/2012 Peterken
8,186,090 B1 5/2012 Chiarolanza et al.
8,209,896 B1 7/2012 Cashwell
8,234,808 B2 8/2012 Lewis et al.
8,245,427 B2 8/2012 Gomez
8,245,429 B2 8/2012 Kuczynko et al.
D668,311 S 10/2012 Rogers et al.
8,307,750 B2 11/2012 Vuksanovich et al.
D674,859 S 1/2013 Robbins et al.
8,342,075 B2 1/2013 Gomez
8,375,616 B2 2/2013 Gomez et al.
8,387,513 B2 3/2013 Gomez et al.
8,393,107 B2 3/2013 Brown
8,418,389 B1 4/2013 Lukman et al.
8,468,929 B2 6/2013 Larson et al.
8,479,429 B2 7/2013 Barrett et al.
8,516,731 B2 8/2013 Cabahug et al.
8,539,708 B2 9/2013 Kenney et al.
8,631,601 B2 1/2014 Langevin et al.
8,689,477 B2 4/2014 Gomez et al.
8,689,672 B2 4/2014 Cassels
8,726,559 B1 5/2014 Mueller
8,746,125 B2 6/2014 Gomez et al.
8,769,855 B2 7/2014 Law
8,783,159 B2 7/2014 Gomez et al.
8,806,792 B2 8/2014 Yan et al.
8,806,793 B2 8/2014 Daniel et al.
D712,998 S 9/2014 Gomez
8,844,424 B2 9/2014 Gomez
8,863,426 B1 10/2014 Zinsner
8,887,426 B2 11/2014 Feese et al.
8,943,947 B2 2/2015 Gomez
8,950,312 B2 2/2015 Gomez
8,955,422 B1 2/2015 Schumacher
8,966,800 B1 3/2015 Olson
9,038,304 B1 * 5/2015 Hu ..... 42/49.01
D735,288 S 7/2015 Gomez
9,140,506 B2 9/2015 Gomez
9,234,713 B1 1/2016 Olson
9,291,414 B2 3/2016 Gomez
2003/0089014 A1 5/2003 Schuerman
2003/0101631 A1 6/2003 Fitzpatrick et al.
2003/0110675 A1 6/2003 Garrett et al.
2003/0126781 A1 7/2003 Herring
2003/0136041 A1 7/2003 Herring
2004/0020092 A1 * 2/2004 Christensen ..... F41A 9/70 42/49.01
2004/0049964 A1 3/2004 Vais
2004/0055200 A1 3/2004 Fitzpatrick et al.
2005/0011345 A1 1/2005 Herring
2005/0011346 A1 1/2005 Wolff et al.
2005/0016374 A1 1/2005 Pescini
2005/0115140 A1 6/2005 Little
2005/0183310 A1 8/2005 Finn
2005/0183317 A1 8/2005 Finn
2005/0188590 A1 9/2005 Baber et al.
2005/0223613 A1 10/2005 Bender
2005/0262752 A1 12/2005 Robinson et al.
2006/0026883 A1 2/2006 Hochstrate et al.
2006/0065112 A1 3/2006 Kuczynko et al.
2006/0283067 A1 12/2006 Herring
2007/0012169 A1 1/2007 Gussalli Beretta et al.
2007/0033850 A1 * 2/2007 Murello ..... F41C 23/16 42/71.01
2007/0033851 A1 2/2007 Hochstrate et al.
2007/0051236 A1 3/2007 Groves et al.
2007/0199435 A1 8/2007 Hochstrate et al.
2007/0234897 A1 10/2007 Poff
2008/0016684 A1 1/2008 Olechnowicz et al.
2008/0029076 A1 * 2/2008 Liang ..... 124/51.1
2008/0092422 A1 4/2008 Daniel et al.
2008/0092733 A1 4/2008 Leitner-Wise et al.
2008/0276797 A1 11/2008 Leitner-Wise
2009/0000173 A1 1/2009 Robinson et al.
2009/0007477 A1 1/2009 Robinson et al.
2009/0031606 A1 2/2009 Robinson et al.
2009/0031607 A1 2/2009 Robinson et al.
2009/0107023 A1 4/2009 Murphy
2009/0151213 A1 6/2009 Bell
2009/0178325 A1 7/2009 Veilleux
2010/0071246 A1 3/2010 Vesligai
2010/0122483 A1 5/2010 Clark
2010/0126054 A1 5/2010 Daniel et al.
2010/0154275 A1 6/2010 Faifer
2010/0162604 A1 7/2010 Dubois
2010/0186276 A1 7/2010 Herring
2010/0205846 A1 8/2010 Fitzpatrick et al.
2010/0236394 A1 9/2010 Gomez
2010/0242334 A1 9/2010 Kincel
2010/0269682 A1 10/2010 Vuksanovich et al.
2010/0281734 A1 11/2010 Rousseau et al.
2010/0287808 A1 11/2010 King
2010/0313459 A1 12/2010 Gomez
2010/0319231 A1 12/2010 Stone et al.
2010/0319527 A1 12/2010 Giefing
2011/0005384 A1 1/2011 Lewis et al.
2011/0016762 A1 1/2011 Davies
2011/0061281 A1 3/2011 Kapusta et al.
2011/0094373 A1 4/2011 Cassels
2011/0247254 A1 10/2011 Barnes
2012/0030983 A1 2/2012 Kuczynko et al.
2012/0030987 A1 * 2/2012 Lee, III ..... 42/87
2012/0042557 A1 2/2012 Gomez et al.
2012/0073177 A1 3/2012 Laney et al.
2012/0111183 A1 5/2012 Hochstrate et al.
2012/0132068 A1 5/2012 Kucynko
2012/0137556 A1 6/2012 Laney et al.
2012/0137562 A1 6/2012 Langevin et al.
2012/0137869 A1 6/2012 Gomez et al.
2012/0137872 A1 6/2012 Crommett
2012/0152105 A1 6/2012 Gomez et al.
2012/0167424 A1 7/2012 Gomez
2012/0180354 A1 7/2012 Sullivan et al.
2012/0186123 A1 7/2012 Troy et al.
2012/0204713 A1 8/2012 Patel
2012/0222344 A1 9/2012 Werner
2012/0260793 A1 10/2012 Gomez
2013/0055613 A1 3/2013 Gomez et al.
2013/0068089 A1 3/2013 Brown
2013/0152443 A1 6/2013 Gomez et al.
2013/0174457 A1 7/2013 Gangl et al.
2013/0192114 A1 8/2013 Christenson
2013/0205637 A1 8/2013 Patel
2013/0263732 A1 10/2013 Kucynko
2013/0269232 A1 * 10/2013 Harris et al. ..... 42/49.01
2013/0269510 A1 10/2013 Sullivan
2014/0026459 A1 1/2014 Yan et al.
2014/0026744 A1 1/2014 Gomez et al.
2014/0033590 A1 2/2014 Gomez
2014/0041518 A1 2/2014 Neitzling
2014/0060293 A1 3/2014 Gomez
2014/0060509 A1 * 3/2014 Tseng ..... 124/40
2014/0068987 A1 3/2014 Burt
2014/0075817 A1 3/2014 Gomez
2014/0076144 A1 3/2014 Gomez
2014/0076146 A1 3/2014 Gomez

(56) References Cited

U.S. PATENT DOCUMENTS

| | | | | |
|---|---|---|---|---|
| 2014/0090283 | A1 | 4/2014 | Gomez | |
| 2014/0163664 | A1 | 6/2014 | Goldsmith | |
| 2014/0190056 | A1 | 7/2014 | Troy et al. | |
| 2014/0259843 | A1 | 9/2014 | Matteson | |
| 2014/0373415 | A1* | 12/2014 | Faifer | 42/49.01 |
| 2015/0027427 | A1* | 1/2015 | Maeda | 124/73 |
| 2015/0075052 | A1* | 3/2015 | Boyarkin | 42/87 |
| 2015/0135942 | A1 | 5/2015 | Gomez | |
| 2016/0084596 | A1 | 3/2016 | Gomez | |
| 2016/0116240 | A1 | 4/2016 | Gomez | |

OTHER PUBLICATIONS

In the U.S. Patent and Trademark Office, Notice of Allowance in re: U.S. Appl. No. 13/430,281, dated Nov. 5, 2013, 7 pages.

Iannamico, "The U.S. Ordnance Deparatment Tests The German FG-42," Journal Article: The Small Arms Review, 2007: vol. 10(9), pp. 83-88.

International Search Report for PCT/US07/16133 mailed Nov. 6, 2008.

LWRC REPR 7.62mm Photo Gallery, [online], [retrieved on Nov. 5, 2009]. Retrieved from the Internet: <URL: http://www.xdtalk.com/forums/ar-talk/135060-lwrc-repr-7-62mm-photo-gallery.html.

12" LWRC REPR SBR, [online], [2011]. Retrieved from the Internet: <URL: http://forum.lwrci.com/viewtopic.php?f=35&t=10081.

Charlie Cutshaw, "Fal Fever!" Combat Tactics, www.surefire.com; Fall 2005; 14 pages.

Rob Curtis, "AAC's MPW "Honey Badger" don't care . . . ;" Military Times GearScout (http://blogs.militarytimes.com/gearscout/2011/10/15/aacs-mpw-h-oney-badger-dont-care/); Oct. 15, 2011 [Retrieved on May 17, 2013] (2 web pages), plus 4 enlarged photographs from the web pages.

Rob Curtis, Reaction Rod by Geissele Automatics, Military Times—Gear Scout, Oct. 12, 2012; , [online], [retrieved on Nov. 12, 2015]. Retrieved from the Internet: <URL: http://gearscout.militarytimes.com/2012/10/12/reaction-rod-by-geissele-automatics/>.

David Crane, "LMT MRP Piston/Op-Rod System v. HK416: 2,000-Round Head-to-Head Test," Defense Review (www.defensereview.com); Feb. 23, 2009 (5 web pages), plus 6 enlarged photographs from the web pages. [Reprint of text retrieved Nov. 12, 2015, online], Retrieved from the Internet: <URL: http://www.defensereview.com/lmt-mrp-pistonop-rod-system-vs-hk416-2000-round-head-to-head-test/>.

* cited by examiner

EXTERNALLY LOADING SEMI-AUTOMATIC FIREARM WITH INTEGRAL OR NON-REMOVABLE FEEDING DEVICE

CROSS-REFERENCE TO RELATED APPLICATIONS

This application is claims benefit of U.S. Provisional Application No. 61/925,783 filed Jan. 10, 2014, the contents of which is incorporated by reference herein in its entirety.

FIELD OF THE INVENTION

The present invention relates to semi-automatic firearm systems, and more specifically, a semi-automatic firearm system with an integral or non-removable ammunition reservoir.

BACKGROUND OF THE INVENTION

All U.S. patents and applications and all other published documents mentioned anywhere in this application are incorporated herein by reference in their entirety.

The M16 family of semi-automatic firearms, including AR-15/AR-10 rifles, has gained significant success with military, law enforcement and civilians alike. The continued evolvement of these firearms is diverse with variations being developed regularly due to the inherent modularity of the base platform. The design of these rifles has been refined thereby improving functional reliability, expanding mission roles, and reducing manufacturing costs; however, the design principles have not been significantly improved. There are multiple variations in the design of these rifles for various calibers.

Typically these rifles are loaded using an ammunition magazine that is loaded apart from the rifle. Once the magazine is loaded, the magazine is inserted into the magazine well located in the lower receiver of the rifle system. The standard magazine well is straight walled and designed to receive any magazine which conforms to its basic shape and latch mechanism, well-known in the prior art. The ability of the user to quickly insert a magazine is of paramount importance for military, paramilitary personnel and civilian users. Factory magazine wells are narrow and easy to miss when the users are careless with inserting the magazine into the magazine well. Damage to the feed lips of the magazine occurs when the user attempts to insert the magazine into the magazine well and strikes the magazine lip into the side of the magazine well. This type of damage can lead to misfires and unnecessary wear and tear on the rifle. Furthermore, using magazines can be cumbersome, leading to the user dropping and fouling the magazine and rounds prior to insertion into the magazine well. This is not desired as it can lead to misfires.

The object of the present invention is to improve the loading design of these rifles and overcome the undesirable features of using a separate magazine for loading ammunition. The present invention provides a non-removable or integral feeding device to eliminate the possibility of the feeding device (e.g., ammunition magazines) from being lost or damaged when out in the field, or from damaging the weapon system during insertion of an ammunition magazine. The present invention also allows for a more robust and precision construction that aids in the reliability of the firearm.

SUMMARY OF THE INVENTION

Embodiments of the present invention solve many of the problems and/or overcome many of the drawbacks and disadvantages of the prior art by providing weapon or rifle systems and methods for loading said weapon or rifle systems with one or more cartridges of ammunition without the need of using a removable or external and separate ammunition magazine.

Embodiments of the present invention may include a lower receiver for use with an M16 type of weapon or rifle system, including an AR-15 and AR-10 rifle systems. In one aspect, the lower receiver is modified for loading one or more cartridges through an aperture into an ammunition well or reservoir that is an integral or non-removable feeding device, without having to open the action (receiver or receivers) or without disassembly (fully or partially) of the weapon or rifle system. As provided herein, the ammunition well or reservoir is designed to have the loading aperture on a lateral side of the ammunition well or reservoir. The ammunition well or reservoir of the lower receiver has a pull channel, a follower pull coupled to the pull channel with screws, and a follower adapted for intermediate coupling or contact with the follower pull, wherein the intermediate contact occurs during retraction of the follower and compression of a follower spring. In one embodiment the pull channel is capable of snapping or locking into contact with a bottom cover or with the ammunition well. The pull channel can be snapped or locked into contact with the bottom cover or with the ammunition well when the ammunition well or reservoir is emptied, partially loaded or completely loaded. When the user moves the pull channel away from the lower receiver or moves it to snap it onto the lower receiver, the follower pull passes along a recessed path within a lateral side of the ammunition well or reservoir, thereby not impacting or impeding the movement of the cartridges within the ammunition well or reservoir.

In one aspect, the ammunition well or reservoir also has an ammunition feeding device with a feed lip coupled to or in the upper portion of the ammunition well or reservoir. The feed lip presents one cartridge at a time for extraction by the bolt carrier group into the chamber through the action of the bolt carrier group. The ammunition feeding device is coupled to the ammunition well or reservoir with one or more screws and comprises at least one plunger. The ammunition well or reservoir also has a bottom cover coupled to or in the bottom portion of the ammunition well or reservoir. The bottom cover has a number of guide pins that properly align and place the bottom cover in position and one or more screws that couple the bottom cover to or in the lower portion of the ammunition well or reservoir.

In one embodiment of the invention, the ammunition well houses a follower and a follower spring that work in unison to force cartridges toward the ammunition feeding device with feed lip for extraction by the bolt carrier group. One end portion of the follower spring contacts the bottom of the follower and a bottom portion of the follower spring contacts the bottom cover. When the follower and follower spring are not retracted, the follower spring forces the follower toward the ammunition feeding device with feed lip.

One aspect of certain embodiments of the invention is that the bottom cover is formed with a passage through which the follower pull passes and moves in a relative perpendicular manner to the surface of the bottom cover. The follower pull is coupled with the pull channel that allows a user to pull the pull channel away from the ammunition well and retract the follower while compressing the follower spring into a retracted and locked position generally past the aperture, thus allowing for loading one or more cartridges. In another embodiment, the lower receiver is equipped with at least one detent for locking the follower in a retracted position locked past the aperture for loading one or more cartridges into the ammunition well or reservoir. Another embodiment of the invention is that the follower pull comprises a lipped edge that contacts a groove on the ammunition feeding device with a feed lip. This contact is used to retract the follower to a position to be locked past the aperture for loading one or more cartridges into the ammunition well or reservoir.

In another embodiment, the lower receiver is part of a weapon or rifle system as provided and discussed herein.

Another aspect of the present invention is a method of loading the weapon or rifle system with a lower receiver described herein. One method of loading a weapon or rifle system of the present invention involves the steps of retracting a pull channel away from the lower receiver by dislodging or unsnapping the pull channel from the bottom cover or lower portion of the ammunition well or reservoir. Once uncoupled from the bottom cover or lower portion of the ammunition well, the pull channel is pulled generally in a perpendicular direction away from the lengthwise plane of the lower receiver. The pulling of the pull channel continues until the follower pull has retracted and locked the follower and compressed the follower spring to a point generally past the aperture allowing the user to load one or more cartridges into the ammunition well or reservoir. Locking the retracted follower and compressed follower spring at a point generally past the aperture is through the use of a detent positioned on a lateral side of the ammunition well or reservoir. With the follower locked and retracted and any aperture covers opened for loading, the user inverts the weapon or rifle system. In another embodiment, the weapon or rifle system can be inverted prior to retracting and locking the follower at a point generally past the aperture.

With the weapon or rifle system inverted and the follower retracted and locked, the user loads one or more cartridges through the aperture. With one or more cartridges loaded up to a maximum capacity for the ammunition well or reservoir, the follower and follower spring are released from the retracted and locked position by disengaging the detent. This allows the follower spring to force the follower into contact with the one loaded or last loaded cartridge and forces the cartridge or cartridges toward the ammunition feeding device with feed lip for extraction by the bolt carrier group. After disengaging the detent, the pull channel is pushed toward the lower receiver and locked on the bottom cover or the lower portion of the ammunition well or reservoir.

In another embodiment, retracting the follower and compressing the follower spring to a point generally past the aperture for loading by pulling the pull channel will engage the detent to lock the follower at the point generally past the aperture for loading. In another embodiment, pushing the pull channel toward the lower receiver will disengage the detent and release the retracted follower and the compressed follower spring, thereby forcing the loaded cartridge or cartridges toward the ammunition feeding device with feed lip for extraction by the bolt carrier group.

Retraction of the follower and compression of the follower spring is managed by a lipped edge or similar design on the follower pull that contacts a groove or similar design on the follower. Pulling the pull channel away from the lower receiver brings the lipped edge or similar design of the follower pull into contact with the grooved edge or similar design of the follower and pulls the follower in the direction the pull channel is pulled until the follower is retracted and locked at a point generally past the aperture for loading one or more cartridges.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF THE PREFERRED EMBODIMENTS

A weapon system for an externally loaded semi-automatic firearm with an integral or non-removable feeding device is described. The examples described herein relate to a weapon system with an improved lower receiver for illustrative purposes only. The weapon system and methods described herein may be used for many different gun types, including, for example, AR-15/AR-10 rifles, modern sporting rifles and pistols with removable feeding devices (e.g., magazines) that are prone to being lost and easily damaged due to construction and use, as well as others.

Although not required, the weapon or rifle systems and methods are described in the general context of the M16 type family of rifles, including AR-15/AR-10 rifles and all of their derivatives. These weapon or rifle systems are described in basic and specific detail in U.S. Pat. Nos. 7,444,775, 7,461,581, 5,726,377, 3,366,011, 7,806,039, for example, which are incorporated herein by reference in their entirety. Characteristics discussed generally herein can be found in detail in the referenced U.S. Patents incorporated herein by reference in their entirety. For example, upper receivers, trigger mechanisms, gas operating systems (i.e., direct or indirect gas operated), bolts and bolt carrier groups, hand guards and rails, buffer tubes and springs, stocks, and lower receiver aspects other than those improved by the present invention, and the multiple variations of the known weapon or rifle systems will be understood by the skilled artisan to be usable with the disclosed invention.

Figure 1:
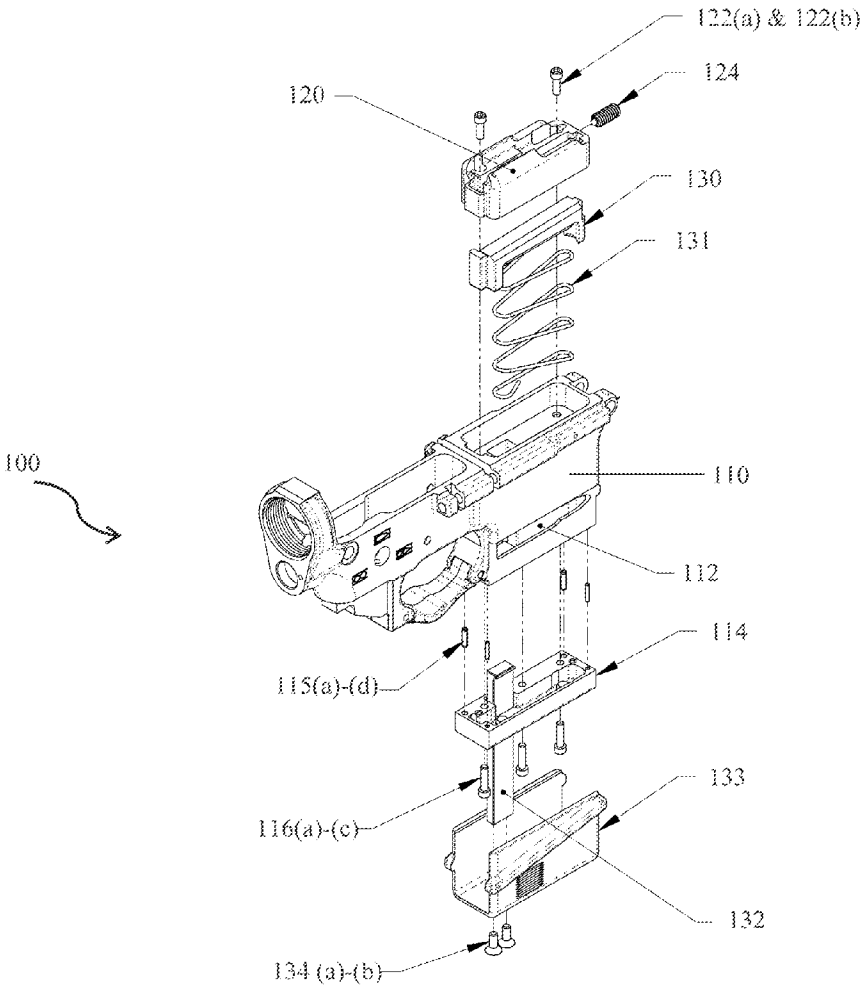
FIG. 1 shows a lower receiver of a rifle system of the present invention in expanded form.

A firearm system of the present invention, most notably its lower receiver 100, is shown in FIG. 1 in expanded view. The frame of lower receiver 100 has an ammunition well 110 for receiving ammunition or cartridges through an external loading port aperture 112, wherein aperture 112 is sized depending on the rifle system and cartridge size of the rifle system. As used herein, an ammunition well and reservoir are interchangeable terms. External loading port aperture 112 can also have a port flap located on the external surface of ammunition well 110, preferably on the side or back, and equipped to be opened as needed for loading ammunition and closed after loading ammunition. Coupled in the upper portion of ammunition well 110 is an ammunition feeder with feed lip 120, from which a bolt carrier group extracts the presented cartridge from the feeding device. The ammunition feeder with feed lip 120 is coupled in the upper portion of ammunition well 110 via screws 122(*a*) and 122(*b*). The number of screws and locations of the screws may vary depending on the weapon system and type, form and style of ammunition feeder with feed lip desired. In certain embodiments, ammunition feeder with feed lip 120 is mated with plunger 124 and located within a top portion of ammunition well 110.

Coupled to the bottom portion of ammunition well 110 is bottom cover 114. Alignment pins 115(*a*)-(*d*) are used to align bottom cover 114 within the bottom portion of ammunition well 110. Screws 116(*a*)-(*c*) are used to couple bottom cover 114 within the bottom portion of ammunition well 110. The number of and position of alignment pins to be used may vary depending on the weapon system to be used.

Within ammunition well 110 and located between the coupled ammunition feed device with feed lip 120 and bottom cover 114 is a follower 130 and follower spring 131, each sized for movement between ammunition feeder with feed lip 120 and bottom cover 114. Follower 130 is designed to force cartridges toward ammunition feeder with feed lip 120 for extraction by the bolt carrier group as the bolt carrier group moves from a generally recessed position toward the chamber, resulting in the bolt carrier group extracting the cartridge from ammunition feeder with feed lip 120. As cartridges are extracted from ammunition well 110, follower 130 is forced by follower spring 131 closer and closer toward feed lip 120, until follower 130 is in relative contact with ammunition feeder with feed lip 120. When ammunition well 110 is empty of cartridges, follower spring 131 is essentially fully expanded or near full expansion, meaning the least amount of force is applied on follower 130. Follower 130 and follower spring 131 are retracted toward bottom cover 133 by use of follower pull 132. Follower pull 132 is coupled to pull channel 133 with screws 134(*a*)-(*b*). The number and position of screws coupling follower pull 132 to pull channel 133 may vary depending on the weapons system to be used. Follower 130 is provided with a groove for intermediate coupling or intermediate contact with follower pull 132. This groove allows follower 130 to be retracted and locked in the retracted position by use of a detent for loading as discussed herein. The lipped edge of follower pull 132 is only required to couple with or contact with follower 130 during retraction of follower 130, which retraction compresses follower spring 131 to the retracted position.

Follower pull 132 is coupled to one side and to one end of pull channel 133. Follower pull 132 also passes through a passage in bottom cover 114 in a relative perpendicular manner. Follower pull 132 also comprises a lipped edge that enables follower pull 132 to engage or grasp follower 130 and retract follower 130 and follower spring 131 to a retracted position for loading cartridges into ammunition well 110 through aperture 112. Ammunition well 110 is designed with a recessed channel that allows movement of follower pull 132 in a relative perpendicular path to bottom cover 114 and ammunition feeder with feed lip 120. As ammunition well 110 is emptied of cartridges, follower 130 and follower spring 131 extend by spring force toward ammunition feeder with feed lip 120. Once ammunition well 110 is emptied of cartridges, follower 130 is designed to come to rest, in part, against the lipped edge of follower pull 132. At this point, pull channel 133 can be pulled in a generally perpendicular direction away from ammunition well 110 until follower 130 and follower spring 131 are retracted and locked to a point past aperture 112 away from ammunition feeder with feed lip 120, thereby allowing the user to load cartridges through aperture 112. Follower 130 is locked into this position through use of a detent that can be spring loaded and positioned about ammunition well 110 as desired in relation to the position of aperture 112. Positioning of the detent, however, must allow for follower 130 to be retracted and locked past aperture 112 so that one or more cartridges can be loaded.

With follower 130 in the retracted and locked position (FIG. 2), the weapon system can be loaded by inverting the weapon system. While inverted and relatively parallel to the ground, the user can insert cartridges into aperture 112, whereby the cartridges will move or fall generally toward ammunition feeder with feed lip 120 as they are loaded. Once the user has loaded one or more cartridges into ammunition well 110, the user can then force pull channel 133 toward ammunition well 110. This action moves follower pull 132 toward ammunition feeder with feed lip 120 through the recessed channel, thereby allowing follower spring 131 to expand and force follower 130 into contact with the closest cartridge and forcing the one or more cartridges toward ammunition feeder with feed lip 120. This places the first loaded cartridge in direct line with the bolt carrier group or slide so that the first loaded cartridge can be chambered.

Figure 2:
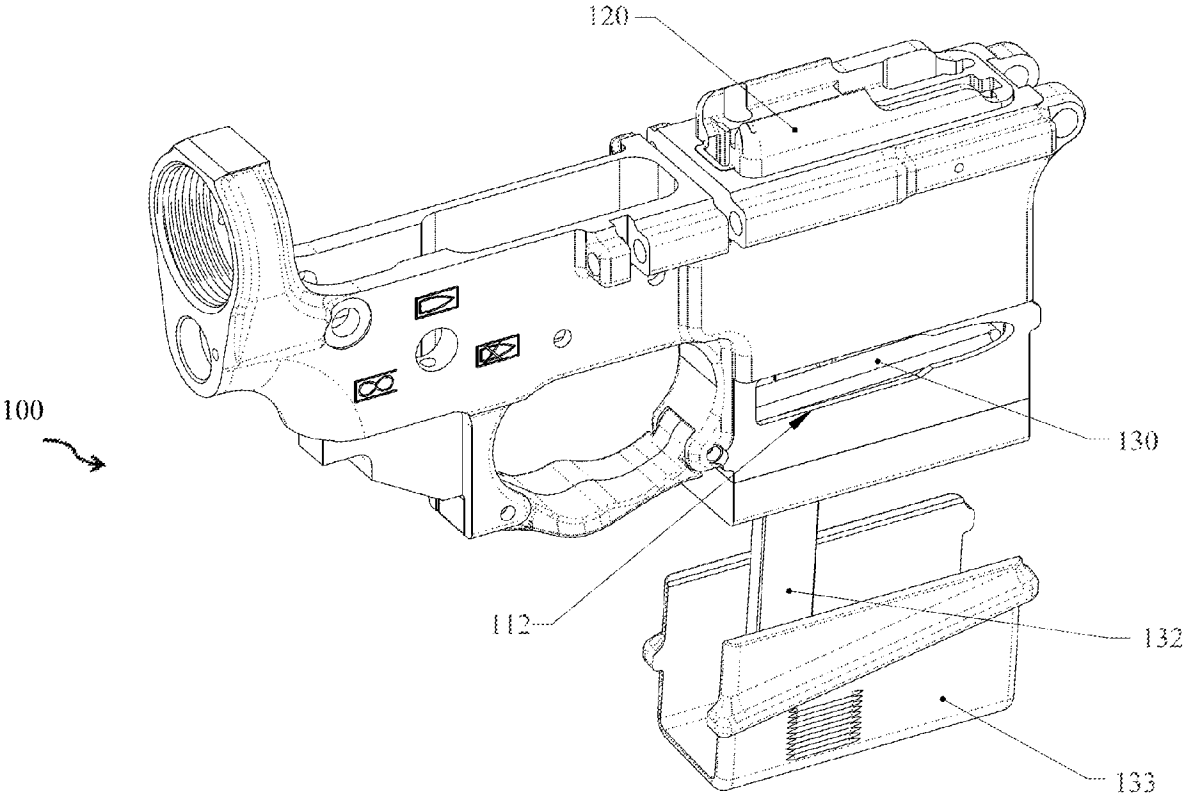
FIG. 2 shows another view of a lower receiver of a rifle system of the present invention.

While FIGS. 1 and 2 show aspects of the invention from one lateral side of the lower receiver, the invention also encompasses the described aspects from either side of the lower receiver. By way of example, FIGS. 1 and 2 demonstrate a system designed for loading cartridges from the right side of the weapon system; however, the skilled artisan will realize that these aspects can be designed and oriented for loading the weapon or rifle system from the left side of the weapon system as well. Therefore, the aspects of the invention can be designed and oriented for loading from either lateral side of ammunition well 110.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

What is claimed is:

1. A lower receiver of a rifle comprising:

a non-removable ammunition well or reservoir integral with the lower receiver for accepting the one or more cartridges;

an aperture on a lateral side of the non-removable ammunition well or reservoir to load the one or more cartridges;

a pull channel;

a follower pull coupled to the pull channel;

a follower adapted for engaging with the follower pull via a lip on the follower pull cooperating with a groove on the follower with the follower pull; and a bottom cover coupled to an underside of the ammunition well or reservoir of the lower receiver, wherein the follower pull at least partially passes through the bottom cover;

wherein the pull channel, follower pull, and follower are arranged in an order generally perpendicular to a longitudinal direction of a firearm barrel; and wherein the pull channel, follower pull, and follower are capable of being retracted to allow the one or more cartridges to be loaded.

2. The lower receiver of claim 1, wherein the lateral side of the non-removable ammunition well or reservoir is a right or left side of said lower receiver.

3. The lower receiver of claim 1, further comprising one or more alignment pins for aligning the bottom cover with an underside of the ammunition well or reservoir of the lower receiver; and one or more screws coupling the bottom cover to the underside of the ammunition well or reservoir.

4. The lower receiver of claim 1, wherein the follower pull is coupled to the pull channel by one or more screws.

5. The lower receiver of claim 1, further comprising a follower spring between the follower and the bottom cover.

6. The lower receiver of claim 1, further comprising an ammunition feeding device with a feed lip coupled to the upper portion of the ammunition well or reservoir of the lower receiver above the follower.

7. The lower receiver of claim 6, wherein the feed lip is coupled to the lower receiver by one or more screws.

8. A rifle comprising:

an upper receiver;

a lower receiver comprising a non-removable ammunition well or reservoir for accepting one or more cartridges, and an aperture on a lateral side of the non-removable ammunition well or reservoir to load the one or more cartridges;

a pull channel;

a follower pull coupled to the pull channel;

a follower adapted for engaging with a follower pull via a lip on the follower pull cooperating with a groove on the follower;

a bottom cover coupled to an underside of the ammunition well or reservoir of the lower receiver;

wherein the follower pull at least partially passes through the bottom cover;

wherein the pull channel, follower pull, and follower are arranged in an order generally perpendicular to a longitudinal direction of a firearm barrel; and wherein the pull channel, follower pull, and follower are capable of being retracted to allow one or more cartridges to be loaded.

9. The rifle of claim 8, wherein the upper receiver is coupled to the lower receiver by a hinge and hinge pin.

10. A method for loading the rifle of claim 8, the method comprising:

retracting the pull channel away from the lower receiver of the rifle in a relative perpendicular direction, wherein the pull channel is coupled to the follower pull with a lipped edge for intermediately engaging the follower, and wherein retracting the pull channel compresses a follower spring communicated between the follower and the bottom cover;

locking the follower into a retracted position by use of a detent;

inserting or loading one or more cartridges through the aperture in the lower receiver into the ammunition well or reservoir in the lower receiver; and pushing the pull channel toward the lower receiver until in contact with the bottom cover thereby releasing the detent.

11. The method of claim 10, wherein the rifle is inverted prior to or after retracting and locking the pull channel in the retracted position.

12. The method of claim 10, wherein the rifle is inverted prior to inserting the one or more cartridges.

13. The method of claim 12, further comprising un-inverting the rifle prior to firing.

14. The method of claim 10, wherein pushing the pull channel toward the lower receiver releases the detent and decompresses the follower spring, which then applies force to the follower and the follower forces the one or more cartridges toward the ammunition feeding device with a feed lip.

15. The method of claim 10, wherein pushing the pull channel forces at least one cartridge through the feed lip coupled to the lower receiver.

16. The method of claim 10, wherein the pushing comprises pushing the pull channel into fixed contact with the bottom cover.

17. The method of claim 10, wherein the aperture is on a lateral side of the lower receiver.

18. The method of claim 10, wherein the follower is in contact with the follower pull by a lipped edge on the follower pull cooperating with a groove on the follower.

19. The method of claim 10, wherein the lower receiver is coupled to an upper receiver by a hinge and hinge pin.

* * * * *